United States Patent [19]

Ishida et al.

[11] 4,264,287

[45] Apr. 28, 1981

[54] FUEL PUMP ASSEMBLY OF FUEL INJECTION SYSTEM

[75] Inventors: Yoshiyuki Ishida, Tokyo; Seikoh Satoh, Yokohama, both of Japan

[73] Assignee: Nissan Motor Company, Limited, Yokohama, Japan

[21] Appl. No.: 53,512

[22] Filed: Jun. 29, 1979

[30] Foreign Application Priority Data

Jul. 28, 1978 [JP] Japan ..... 53-104078[U]

[51] Int. Cl.[3] ..... F04B 11/00

[52] U.S. Cl. ..... 417/540; 138/30

[58] Field of Search ..... 417/540; 138/26, 30

[56] References Cited

U.S. PATENT DOCUMENTS

| | | | |
|---|---|---|---|
| 2,662,723 | 12/1953 | Coffey | 417/540 |
| 3,143,969 | 8/1964 | Eames et al. | 417/540 X |
| 3,146,724 | 9/1964 | Cornelsen | 417/540 X |
| 3,540,482 | 11/1970 | Fulmer | 138/30 |

FOREIGN PATENT DOCUMENTS

| | | | |
|---|---|---|---|
| 1538130 | 1/1979 | United Kingdom | 417/540 |

*Primary Examiner*—Christopher K. Moore

[57] ABSTRACT

The casing of a fuel pump section having a motor-driven fuel pump is integrally formed with a damper which is provided with a damping chamber for damping fuel pressure pulsation. The damping chamber is communicable with the interior of the casing of the fuel pump section through apertures formed through the outer wall of the casing so that the damping chamber is supplied with fuel pressurized by the fuel pump. A resilient umbrella type check valve member is securely disposed to cover the apertures of the outer wall of the casing of the fuel pump section so that the fuel flows only in a direction from the interior of the casing to the damping chamber.

8 Claims, 7 Drawing Figures

FUEL PUMP ASSEMBLY OF FUEL INJECTION SYSTEM

This invention relates to a fuel pump assembly including a fuel pump, a check valve and a damper, for use in a fuel injection system of an internal combustion engine, and more particularly to an improvement in arrangement of the check valve and the damper.

It is a main object of the present invention to provide an improved fuel pump assembly including a fuel pump, a check valve and a damper, which is improved in reliability and durability without any troubles.

It is another object of the present invention to provide an improved fuel pump assembly, in which the damping effect to fuel pressure pulsation is improved preventing damage and deterioration of function of a check valve.

It is a still another object of the present invention to provide an improved fuel pump assembly in which a check valve and a damper are formed integrally as a unit, and this unit is installed integrally with the casing of fuel pump assembly, which can omit means for connecting the check valve and the damper so as to prevent fuel leak occurred due to use of such connecting means.

It is a further object of the present invention to provide an improved fuel pump assembly for use in a fuel injection system of an internal combustion engine, which is simple in construction and accordingly the number of the constituting parts is considerably decreased.

It is a still further object of the present invention to provide an improved fuel pump assembly in which a check valve is composed of a resilient umbrella type valve member, which is considerably high in absorbing effect to fuel pressure pulsation and in durability, as compared with a conventional ball type check valve using a ball biased by a spring.

These and other objects, features and advantages of the fuel pump assembly according to the present invention will become more apparent from the following description when taken in conjunction with the accompanying drawings in which like reference numerals are assigned to like parts and elements throughout several figures, in which.

Figure 1:
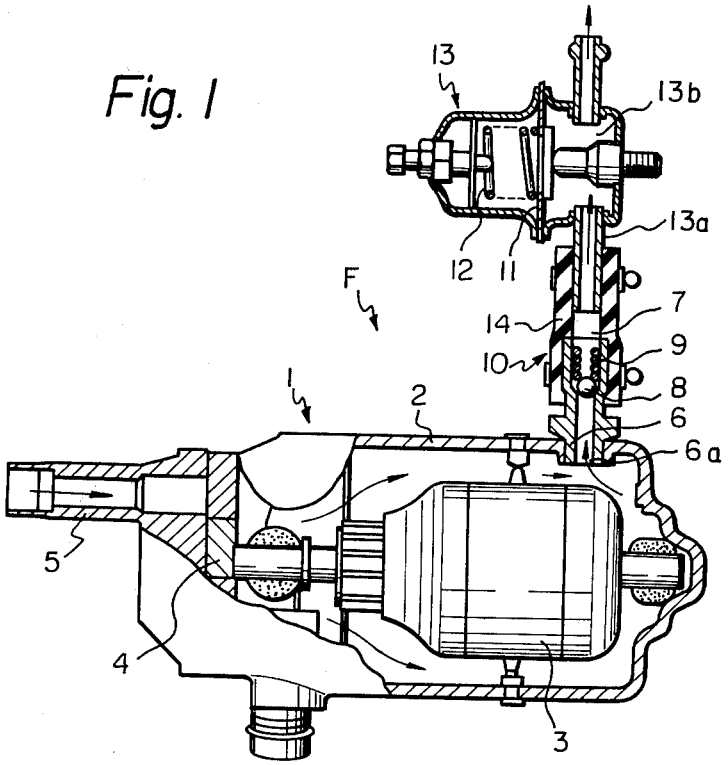
FIG. 1 is a cross-sectional view of a conventional fuel pump assembly.

FIG. 1 shows a conventional fuel pump assembly F which is constructed and arranged to supply fuel under pressure to fuel injectors of a fuel injection system of an internal combustion engine though not shown. The assembly F includes a fuel pump section 1 which is composed of a pump housing 2 in which an electric motor 3 and a fuel pump 4 are disposed as a unit. The fuel pump 4 is drivably connected to the motor 3 so as to be driven by the motor 3. When the pump 4 is driven, fuel is sucked through a fuel inlet pipe 5 into the interior of the housing 2, and then passes through a fuel passage or chamber formed around the motor 3 to be discharged out of the housing 2 from a fuel outlet pipe 6 in which a fuel outlet 6*a* is formed.

A ball-type check valve 10 is provided in a fuel passage 7 formed in the fuel outlet pipe 6 upstream of the fuel outlet 6*a*. The check valve is composed of a ball movably disposed in the fuel passage 7 and biased by a spring 9. A damper 13 is disposed downstream of the check valve 10 in such a manner that a fuel inlet pipe 13*a* thereof is connected through a resilient hose 14 to the pipe 6. The damper 13 is composed of a diaphragm member 11 which is biased by a spring 12. The damper 13 functions to soften or damp the pressure pulsation of the fuel passing through a damping chamber 13*b* of the damper 13. This prevents the vibration of hoses due to the fuel pressure pulsation, and therefore noise due to this vibration is decreased.

However, the fuel pump assembly F of this type has encountered serious problems in which since the check valve 10 is connected with the damper 13 by the rubber hose 14, fuel leak is liable to occur at this connecting section.

Figure 2:
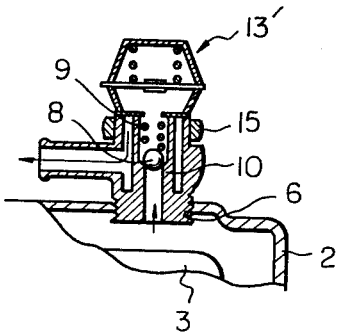
FIG. 2 is a cross-sectional view of the essential part of a proposed fuel supply system.

In order to prevent such fuel leak, it is proposed, as shown in FIG. 2, to directly connect the check valve 10 and the damper 13' by using a ring like connector 15 without the rubber hose. However, even with this arrangement, means for providing a secure sealing between the check valve and the damper is unavoidably required, since the both are formed separatedly and independently. This increases the number of the constituting parts of the fuel pump assembly F and accordingly the process of assembly are complicated.

Furthermore, even with the arrangement shown in FIG. 2, since the check valve 10 uses the ball 8 which is biased on a valve seat surface (no numeral) by the spring 9, the following drawbacks are raised: (1) the ball 8 may be worn away and pushed down into the fuel passage upstream of the valve seat surface. (2) A sufficient check valve function may be lost when the biasing force of the spring 9 is decreased. (3) If the spring 9 is broken down, the broken pieces may be carried into fuel passages and the fuel injectors so that fuel flow through them is blocked.

In view of the above, the present invention contemplates to overcome the above-mentioned problems encountered in conventional and proposed fuel supply devices, by using the check valve having a valve member made of a resilient material such as rubber, and then by forming such a check valve integrally with a damper for dampening fuel pressure pulsation, as a unit which is installed onto the housing of a fuel pump assembly.

Figure 3:
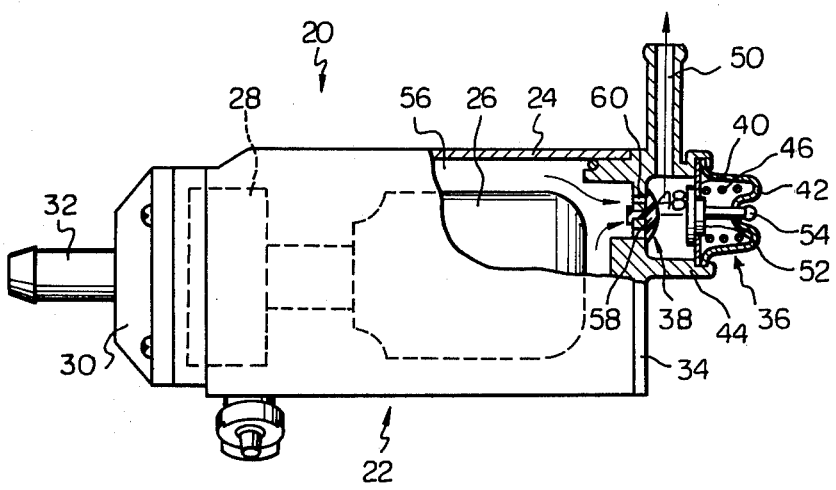
FIG. 3 is a side elevation partly in section of an embodiment of a fuel pump assembly in accordance with the present invention.
Figure 4:
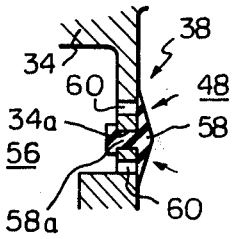
FIGS. 4 and 5 are cross sectional views showing the operations of a valve member of a check valve used in the fuel pump assembly of FIG. 3.
Figure 5:
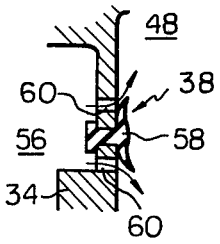

Referring now to FIGS. 3 to 5 of the drawings, there is shown a preferred embodiment of a fuel pump assembly 20 in accordance with the present invention, which is, in this instance, used in a fuel injection system of an internal combustion engine though not shown. The fuel pump assembly 20 comprises a fuel pump section 22 which is composed of a generally cylindrical pump housing 24 in which an electric motor 26 and a fuel pump 28 are disposed as a unit. The fuel pump 28 is driveably connected to the motor 26 and accordingly rotatably driven by the motor 26 to pressurize fuel. One end of the cylindrical housing 24 is sealingly closed with an end wall member 30 which is formed with a fuel inlet pipe 32 through which the fuel is introduced into the interior of the housing 24. The other end of the housing 24 is sealingly closed with an end wall member 34 which is integrally formed with a damper 36 and a check valve 38.

The damper 36 includes a diaphragm member 40 which is secured with a casing to a cylindrical wall portion 44 which is integral with the wall member 34 and whose axis is perpendicular to the wall member 34, by crimping the peripheral edge of the cylindrical portion 44 as shown in FIG. 3. A spring 46 is disposed in a chamber (no numeral) defined between the diaphram member 40 and the casing 42 to bias the diaphragm member 40 leftward in the drawing. A damping chamber 48 is defined inside of the cylindrical wall portion 44 by the diaphragm 40. The damping chamber 48 is communicable out of the assembly 20 through a fuel outlet pipe 50 which is integral with the end wall member 34. The diaphragm member 40 is formed at its central portion with a support member 52 to which a bolt 54 is screwed in so that the moving stroke of the diaphragm member 40 is controllable by rotating the bolt 54.

The check valve 38 is provided at a portion of the end wall member 34 which portion separates the damping chamber 48 and a fuel flow chamber 56 defined within the pump housing 24. The check valve 38 of this instance includes an umbrella type valve member 58 which is made of an oil-resisting rubber. The valve member 58 is formed with a flexible flap portion (no numeral) which covers a plurality of apertures 60 formed through the above-mentioned portion of the end wall member 34. The damping chamber 48 is communicable through the apertures 60 with the fuel flow chamber 56 of the fuel pump section 22. The valve member 58 is installed at the portion of the end wall member 34 by inserting the stem portion **58*a* of the valve member 58 into a central opening 34*a* formed through the portion of the end wall member 34 as clearly shown in FIG. 4. It will be understood that such installation of valve member 58 is carried out prior to the installation of the casing 42 of the damper 36**.

With the thus arranged fuel pump assembly 20, when the fuel pump 28 is driven by the motor 26, the fuel is sucked through the fuel inlet pipe 32 into the fuel flow chamber 56. The fuel in the chamber 56 is admitted under pressure through the check valve 38 into the damping chamber 48. At this moment, the umbrella type valve member 58 of the check valve 38 deforms by the action of the pressurized fuel as shown in FIG. 5 so as to allow the fuel to flow through the apertures 60 as indicated by arrows. When the fuel is introduced into the damping chamber 48, the pressure pulsation of the fuel is effectively softened or dampened. Thereafter, the fuel is discharged out of the device 20 through the fuel outlet 50.

It will be understood that when the pressure in the damping chamber 48 is higher than that in the fuel flow chamber 56, the umbrella type check valve member 58 is in the state shown in FIG. 4 so that the flexible flap portion of the valve member 58 covers the apertures 60 to prevent the fuel downstream of the check valve 38 from flowing back through the apertures 60 to the upstream side of the check valve 38.

The check valve 38 of the type shown in FIG. 3 is lower in pressure loss and in valve opening pressure than conventional check valves which use a ball and a spring, therefore the check valve 38 exhibits a great effect of absorbing the pressure pulsation of the fuel. Besides, such a check valve 38 is simple in construction and accordingly the number of the constituting parts thereof is decreased, which prevents the damage and the deterioration in its function with the passage of time, improving the reliability of the check valve.

With respect to the damper 36, the damping chamber 48 is integrally formed with the check valve 38 and accordingly connecting means for connecting them is unnecessary. As a result, fuel leak at the fuel passage between the check valve and the damping chamber 36 never occurs, in addition to the advantages in that parts for connecting them and sealing members can be omitted. This simplifies the construction of the fuel pump assembly 20, further improving the reliability of the fuel pump assembly 20 including the fuel pump section 22, check valve 38 and the damper 36.

Figure 6:
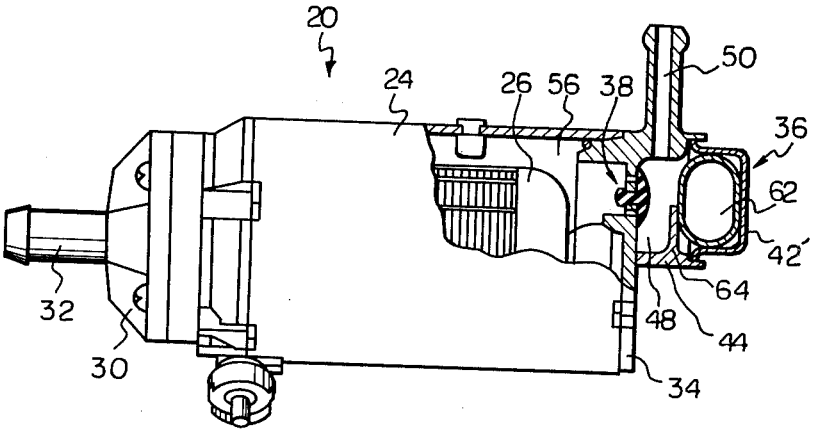
FIG. 6 is a side elevation partly in section of another embodiment of a fuel pump assembly in accordance with the present invention.

FIG. 6 illustrates another preferred embodiment of the fuel pump assembly 20 in accordance with the present invention, which is similar to the embodiment of FIG. 3 except for the construction of the damper 36. In this instance, the damper 36 is composed of a balloon like resilient bag made of an oil-resisting material, which bag is filled with a gas such as $N_2$ gas to be expanded as shown in FIG. 6. The expanded bag 62 is disposed in a space defined between the inner surface of the damper casing 42' and a stopper 64 or projection integral with the cylindrical wall portion 44. As shown, the casing is secured to the cylindrical wall portion 44.

It will be understood that such a bag 62 is elastically deformable upon receiving the fuel pressure and therefore serves effectively as a damper for damping the pressure pulsation of the fuel flowing through the fuel passage leading to the fuel injectors of the fuel injection system.

Figure 7:
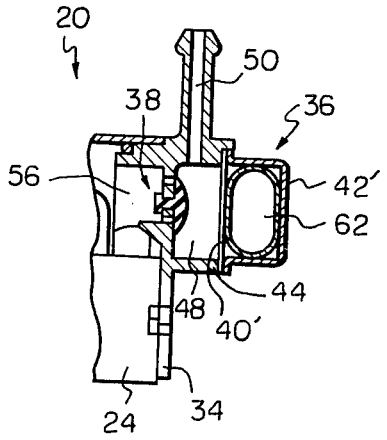
FIG. 7 is a cross-sectional view of the essential part of a further embodiment of a fuel pump assembly in accordance with the present invention.

FIG. 7 illustrates a further preferred embodiment of the fuel pump assembly 20 in accordance with the present invention, which is similar to the embodiment of FIG. 6 with the exception that the resilient bag 62 is disposed in a space defined between the inner surface of the casing 42' and the diaphragm member 40'. The diaphragm member 40' is secured at its peripheral portion to the cylindrical wall portion 44 with the flange portion (no numeral) of the casing 42'. It will be understood that, with this arrangement, the pressure pulsation of the fuel admitted to the damping chamber 48 is effectively damped.

It is to be noted that the damper constructions shown in FIGS. 6 and 7 are advantageous in that a relatively high frequency components of the fuel pressure pulsation are effectively absorbed, as compared with conventional damper constructions.

While the fuel pump assembly 20 which is integrally formed has been shown and described, it may be made by at first forming integrally only the damper 36 and the check valve 38 as a unit, and thereafter installing the unit onto the outer surface of the fuel pump section 22.

What is claimed is:

1. A fuel pump assembly comprising:

a pump housing having an outer wall member inside which a chamber is defined so that a motor and a fuel pump driven by said motor are disposed therein;

means for damping the pressure pulsation of fuel pressurized by said fuel pump, said damping means including a damping chamber formed separate from said chamber of said pump housing and in contact with the outer wall member of said pump housing, said damping chamber being communicable with said chamber of said pump housing through apertures formed through said outer wall member of said pump housing, the fuel in said damping chamber being dischargeable out of said damping chamber through a fuel outlet;

check valve means including a valve member made of a resilient material and disposed to cooperate with said apertures of the outer wall member of said pump housing, said valve member being deformable to open said apertures when the pressure in said chamber of said pump housing is higher than that in said damper chamber, and to close said apertures when the pressure in said chamber of said pump housing is lower than that in said damping chamber.

2. A fuel pump assembly as claimed in claim 1, further comprising a generally cylindrical wall portion with which said damping means is incorporated so as to define said damping chamber interior of said cylindrical wall portion.

3. A fuel pump assembly as claimed in claim 2, in which said valve member is made of an oil-resisting rubber.

4. A fuel pump assembly as claimed in claim 3, in which said valve member is of the umbrella shape and formed with a flexible flap portion covering said apertures of said outer wall member of said pump housing and a stem portion which is securely inserted to an opening formed through said outer wall member.

5. A fuel pump assembly as claimed in claim 2, in which said damping means includes a casing sealingly secured to said cylindrical wall portion, and means elastically deformable upon receiving the pressure of the fuel admitted to said damping chamber, said deformable means being incorporated with said casing so as to define said damping chamber.

6. A fuel pump assembly as claimed in claim 5, in which said deformable means includes a diaphragm member secured with said casing to said cylindrical wall portion, and a spring disposed between said diaphragm member and the inner surface of said casing to bias said diaphragm member, said damping chamber being defined between said diaphragm and said outer wall member of said pump housing.

7. A fuel pump assembly as claimed in claim 5, in which said deformable means includes a resilient bag filled with a gas and disposed interior of said casing, said damping chamber being defined between the surface of said resilient bag and said outer wall member of said pump housing.

8. A fuel pump assembly as claimed in claim 7, in which said deformable means includes a diaphragm member secured with said casing to said cylindrical wall portion, said resilient bag being disposed in a chamber defined between said diaphragm and said casing, said damping chamber being defined between said diaphragm member and said outer wall member of said pump housing.

* * * * *